US006719143B2

(12) United States Patent
Rice

(10) Patent No.: US 6,719,143 B2
(45) Date of Patent: Apr. 13, 2004

(54) READY TO DISPLAY CARTON AND BLANK THEREFOR

(75) Inventor: William J. Rice, Round Lake Beach, IL (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 279 days.

(21) Appl. No.: 10/072,278

(22) Filed: Feb. 8, 2002

(65) Prior Publication Data

US 2003/0150772 A1 Aug. 14, 2003

(51) Int. Cl.[7] ..... B65D 1/22
(52) U.S. Cl. ..... 206/746; 220/240
(58) Field of Search ..... 206/736, 738, 206/745, 746, 747, 774, 769; 229/240

(56) References Cited

U.S. PATENT DOCUMENTS

| | | | | |
|---|---|---|---|---|
| 1,372,809 | A | 3/1921 | Gross | |
| 1,925,102 | A | 9/1933 | Levkoff | |
| 2,152,079 | A | 3/1939 | Mott | |
| 2,420,773 | A | 5/1947 | Dorfman | |
| 2,727,619 | A | 12/1955 | Paige | |
| 2,747,788 | A | 5/1956 | Tilly | |
| 2,816,699 | A | 12/1957 | Nute et al. | |
| 2,970,685 | A | 2/1961 | Mayer | |
| 3,123,277 | A | 3/1964 | Menzies | |
| 3,136,474 | A | 6/1964 | Schaus et al. | |
| 3,139,979 | A | 7/1964 | Russell | |
| 3,228,582 | A | 1/1966 | Osberg | |
| 3,241,737 | A | 3/1966 | Steinbock | |
| 3,276,665 | A | 10/1966 | Rasmussen | |
| 3,276,667 | A | 10/1966 | Johnson et al. | |
| 3,356,279 | A | * 12/1967 | Root | 206/736 |
| 3,447,735 | A | 6/1969 | Whitney | |
| 3,531,045 | A | 9/1970 | Johnson | |
| 3,653,495 | A | 4/1972 | Gray | |
| 3,669,251 | A | 6/1972 | Phillips, Jr. | |
| 3,687,278 | A | 8/1972 | Graham et al. | |
| 3,756,502 | A | 9/1973 | Swanson et al. | |
| 3,858,717 | A | 1/1975 | Peters | |
| 3,884,348 | A | 5/1975 | Ross | |
| 3,917,158 | A | 11/1975 | Dorofachuk et al. | |
| 3,961,706 | A | 6/1976 | Roccaforte et al. | |
| 4,000,811 | A | 1/1977 | Hardison et al. | |
| 4,053,101 | A | 10/1977 | Hart, Jr. | |
| 4,058,206 | A | 11/1977 | Morse et al. | |
| 4,094,403 | A | 6/1978 | Takefman et al. | |
| 4,116,330 | A | 9/1978 | Ellis | |
| 4,201,291 | A | 5/1980 | Davidson | |
| 4,211,322 | A | 7/1980 | Crescenzi et al. | |
| 4,542,847 | A | 9/1985 | Lindstrom | |
| 4,687,094 | A | 8/1987 | Allsop et al. | |
| 4,793,494 | A | 12/1988 | Gordon, Jr. | |
| 4,848,651 | A | 7/1989 | Hartness | |
| 4,946,042 | A | 8/1990 | Ferreri et al. | |
| 5,332,150 | A | 7/1994 | Poirier | |

(List continued on next page.)

FOREIGN PATENT DOCUMENTS

| | | |
|---|---|---|
| FR | 2 162 063 | 11/1972 |

*Primary Examiner*—Shian Luong

(57) ABSTRACT

A carton blank includes first and second spaced main panels and first and second side flaps abutting first and second side edges, respectively, of the first main panel. Third and fourth side flaps abut first and second side edges, respectively, of the second main panel and an intermediate panel is disposed between first ends of the first and second spaced main panels. A cover flap abuts a second end of the second main panel and a display flap includes first and second portions adjacent to one another wherein the first portion is joined to a second end of the first main panel by a score line and the second portion is joined to the second end of the first main panel by a perforated line collinear with the score line.

14 Claims, 11 Drawing Sheets

U.S. PATENT DOCUMENTS 5,350,111 A 9/1994 Vosbikian
5,413,276 A 5/1995 Sheffer
5,415,343 A 5/1995 Vosbikian
5,464,149 A 11/1995 Fowler et al.
5,465,831 A 11/1995 Smith
5,505,371 A 4/1996 O'Neil
5,555,982 A 9/1996 Kuhn et al.
5,651,497 A 7/1997 Ventura et al.
5,657,872 A 8/1997 Leftwich et al.
5,722,584 A 3/1998 Fujiwara
5,826,728 A 10/1998 Sheffer
5,881,884 A 3/1999 Podosek
5,894,933 A * 4/1999 Crews et al. ..... 206/570
5,918,801 A 7/1999 Milio
5,921,398 A 7/1999 Carroll
5,950,915 A 9/1999 Moen
5,957,294 A 9/1999 Kanter
5,967,406 A 10/1999 Moorman
5,979,749 A 11/1999 Bozich
5,979,849 A 11/1999 Williams
D419,440 S * 1/2000 Hansen ..... D9/416
6,073,833 A 6/2000 Desrosiers et al.
6,158,579 A 12/2000 Rosenbaum
6,168,027 B1 1/2001 Esser
6,189,780 B1 2/2001 Kanter
6,209,786 B1 4/2001 Yelton et al.
6,237,757 B1 5/2001 Alpern et al.
6,311,845 B1 11/2001 Uren et al.

* cited by examiner

READY TO DISPLAY CARTON AND BLANK THEREFOR

TECHNICAL FIELD

The present invention relates to product cartons, and more particularly, to cartons that can be converted from a shippable form to a displayable form.

BACKGROUND ART

Finished products are typically packed into cartons and shipped to merchants for sale to the general public. The merchants thereafter unpack the finished products and stack them manually on display racks or store shelves in order for consumers to easily locate and pick out products. This process is time consuming and labor intensive. Certain carton designs have attempted to address this problem through the use of convertible designs that allow the merchant to display products in the cartons in which they were shipped.

Leftwich et al., U.S. Pat. No. 5,657,872, discloses a storage/display container. The container has two removable sides and a removable top cover that enable a merchant to convert the container from a shipping container to a display container. The sides and top cover are removed from the container by the merchant and the products within the container are exposed with the two remaining sides and lips along the front and rear edges of the container defining the boundaries of the container. The front lip of the container can further be removed by the merchant to allow consumers to slide products out of the container if further containers are stacked on top.

Rosenbaum, U.S. Pat. No. 6,158,579, also discloses a storage/display container. The container includes a foldable portion comprised of the top of the container and a portion of the front of the container. A merchant utilizes the foldable portion of the container to create a fold up header at the rear of the container that displays advertising for the products within. After the fold up header is created the front of the container consists of a skirt that defines the front edge of the container and contains the products within.

These container designs allow merchants to display products within the cartons that the products were shipped in and can be placed by the merchant on the floor, countertop or shelves for consumers to view. However, placement of the cartons on a shelving unit creates problems in both designs and neither design allows a merchant to effectively choose between a floor/counter display and a shelf display. Specifically, in the case of the Leftwich et al. patent the container is placed on a shelf with the open side facing out. As a result, when the consumer views the container there is little or no surface space on the side of the container nearest the consumer to identify the products within. This problem may be magnified in regard to flat products or in situations where the products are pushed into the back of the container where the consumer cannot easily view the products within to identify them.

The Rosenbaum container can also be somewhat problematic for consumers and merchants. The container cannot easily fit in the opening between closely spaced shelves because of the fold up header created when the merchant converts the container into the display form. Furthermore, where the shelf spacing is such that the carton will fit in such opening, the fold up header is disposed in back of the shelf where consumers are unable to see printed material on the header due to obstruction and/or a lack of light. Thus, the consumer encounters the same problem as with the Leftwich et al. container, whereby the consumer is left with little viewable container surface by which to identify the products within. Also, the skirt prevents consumers from easily reaching into the bottom of the container to retrieve flat products and interferes with the ability of the merchant to readily ascertain the number of products remaining in the carton.

SUMMARY OF THE INVENTION

In accordance with one aspect of the present invention, a carton blank includes first and second spaced main panels and first and second side flaps abutting first and second side edges, respectively, of the first main panel. The carton blank further includes third and fourth side flaps abutting first and second side edges, respectively, of the second main panel and an intermediate panel disposed between first ends of the first and second spaced main panels. Also provided is a cover flap abutting a second end of the second main panel and a display flap having first and second portions adjacent to one another wherein the first portion is joined to a second end of the first main panel by a score line and the second portion is joined to the second end of the first main panel by a perforated line collinear with the score line.

A further aspect of the present invention comprehends a carton including top and bottom spaced main panels and first and second side flaps abutting first and second side edges, respectively, of the bottom main panel. The carton further includes third and fourth side flaps abutting first and second side edges, respectively, of the top main panel and secured to the first and second side flaps, respectively and an intermediate panel integral with first ends of the top and bottom spaced main panels. A display flap is also provided having first and second portions adjacent to one another wherein the first portion is joined to a second end of the bottom main panel by a score line and the second portion is joined to the second end of the bottom main panel by a perforated line collinear with the score line. A cover flap is joined to a second end of the top main panel and is secured to the display flap.

Other aspects and advantages of the present invention will become apparent upon consideration of the following detailed description.

DESCRIPTION OF THE PREFERRED EMBODIMENTS

Figure 1:
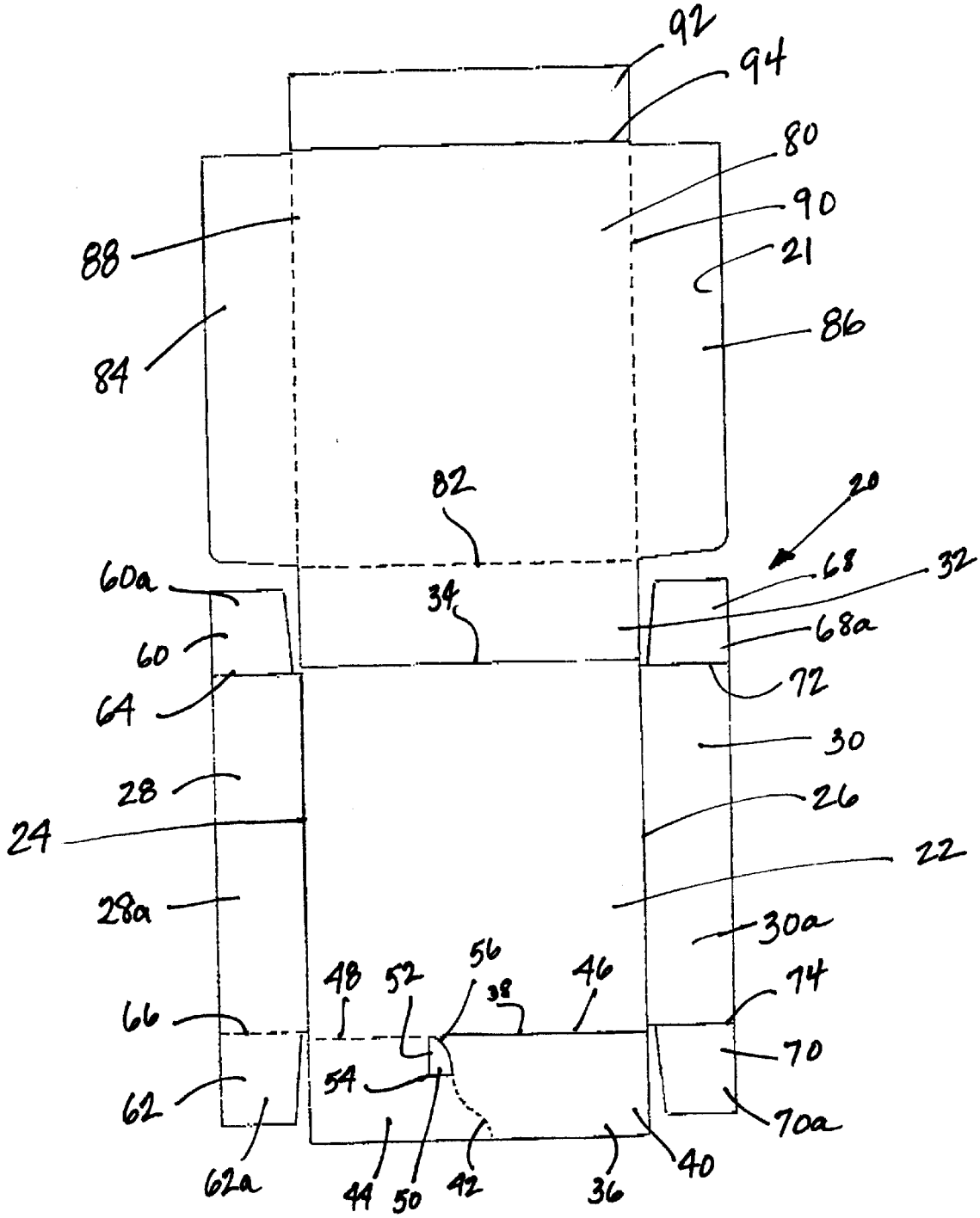
FIG. 1 is an elevational view of one side of a carton blank according to the present invention.

Referring now to FIG. 1, a carton blank 20 includes a first side 21 and comprises sections of corrugated cardboard or other paperboard material connected by score lines and/or perforated lines. A first main panel 22 is attached at score lines 24, 26 to first and second side flaps 28, 30 respectively. The first main panel 22 is also attached to an intermediate panel 32 at a score line 34. The first main panel 22 is further attached to a front or display flap 36 at a line 38.

The front or display flap 36 includes a first section 40 attached at a perforated line 42 to a second section 44. The first section 40 of the display flap 36 is further attached to the first main panel 22 at a score line 46 that forms a first part of the line 38. The second section 44 of the display flap 36 is attached to the first main panel 22 at a scored and perforated line 48. The scored and perforated line 48 forms a second part of the line 38. The display flap 36 further includes a third section 50 disposed between the first and second sections 40, 44. The third section 50 is defined by cut lines 52, 54 and 56.

First and second tabs 60, 62 are attached to opposing ends of the first side flap 28. The first tab 60 is adjacent to the intermediate panel 32 and is connected to the first side flap 28 at a score line 64. The second tab 62 is adjacent to the second section 44 of the display flap 36 and is attached to the first side flap 28 at a scored and perforated line 66. Third and fourth tabs 68, 70 are attached to opposing ends of the second side flap 30 at score lines 72, 74, respectively. The third tab 68 is disposed at a location adjacent the intermediate panel 32 whereas the fourth tab 70 is adjacent the first section 40 of the display flap 36.

Figure 2:
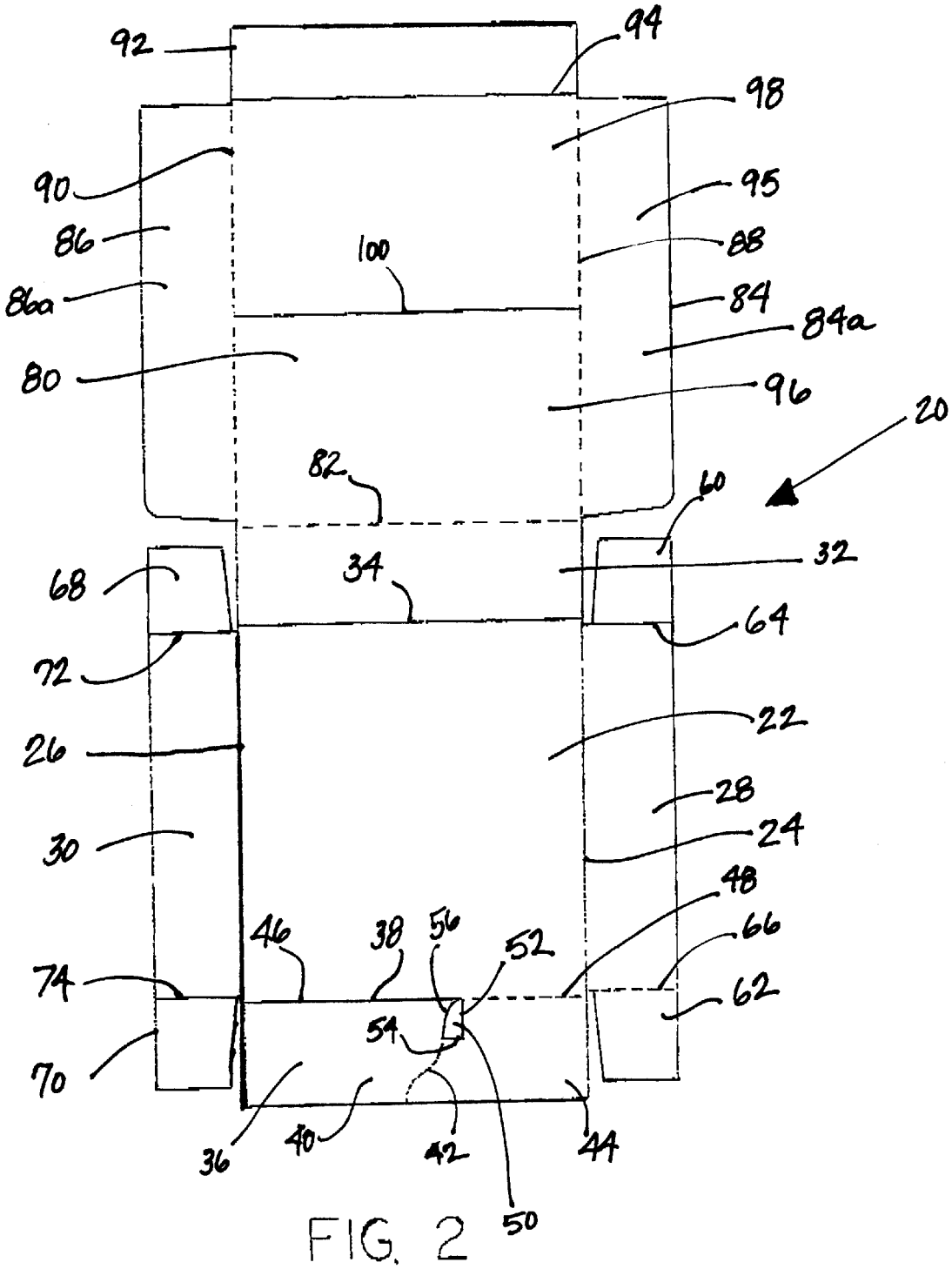
FIG. 2 is an elevational view of the opposite side of the carton blank of FIG. 1.

A second main panel 80 is attached to the intermediate panel 32 at a scored and perforated line 82. Third and fourth side flaps 84, 86 are attached to opposing sides of the second main panel 80 at scored and perforated lines 88, 90, respectively. A cover flap 92 is attached to the second main panel 80 at a score line 94. Furthermore, as shown in FIG. 2, which illustrates a second side 95 of the blank 20, the second main panel 80 is comprised of first and second folding panel sections 96, 98 respectively. The first folding panel section 96 is attached to the second folding panel section 98 at a score line 100 that extends between the scored and perforated lines 88 and 90 Preferably, although not necessarily, the score line 100 forms 90 degree angles with respect to the scored and perforated lines 88 and 90. Also preferably, the score line 100 is formed only in the second side 95 and not the first side 21, although the score line 90 could be formed in both sides 21 and 95, if desired.

Also, in other embodiments any or all of the scored and/or perforated lines could be replaced with other lines of weakness in the corrugated cardboard or other paperboard material used in the carton blank that enable the material to bend or tear as described below.

Industrial Applicability

Figure 3:
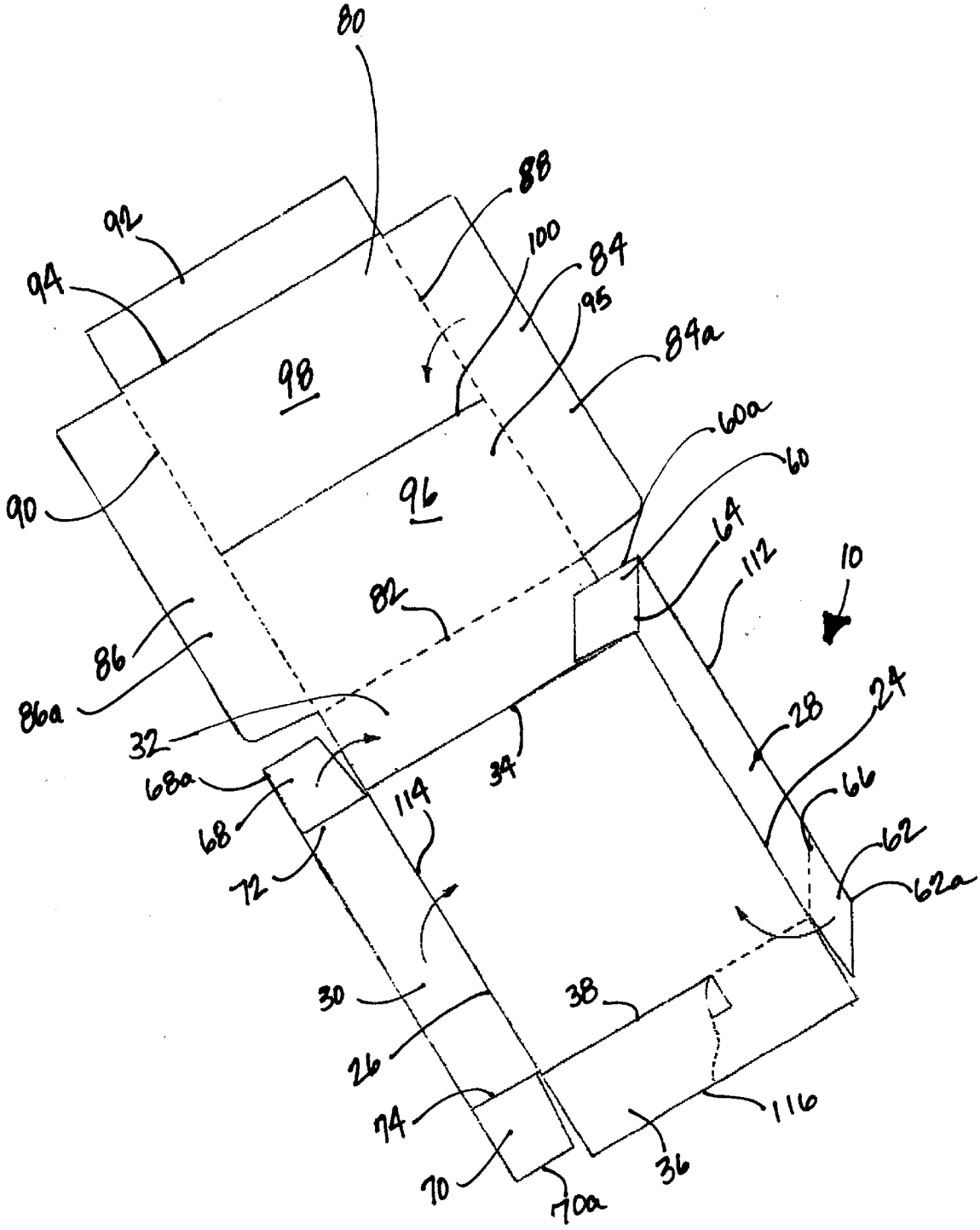
FIGS. 3–6 are isometric views of a process of erecting the carton blank of FIGS. 1 and 2.

The process of erecting the carton blank 20 to obtain an erected carton 110 is illustrated in FIGS. 3–6. Referring first to FIG. 3, the carton blank 10 is oriented by a user with the side 95 having the score line 100 separating the first and second folding panel sections 96, 98 facing up. All of the following steps of erecting the carton 110 are preferably undertaken by equipment designed to accomplish such steps but can also be accomplished manually.

Figure 4:
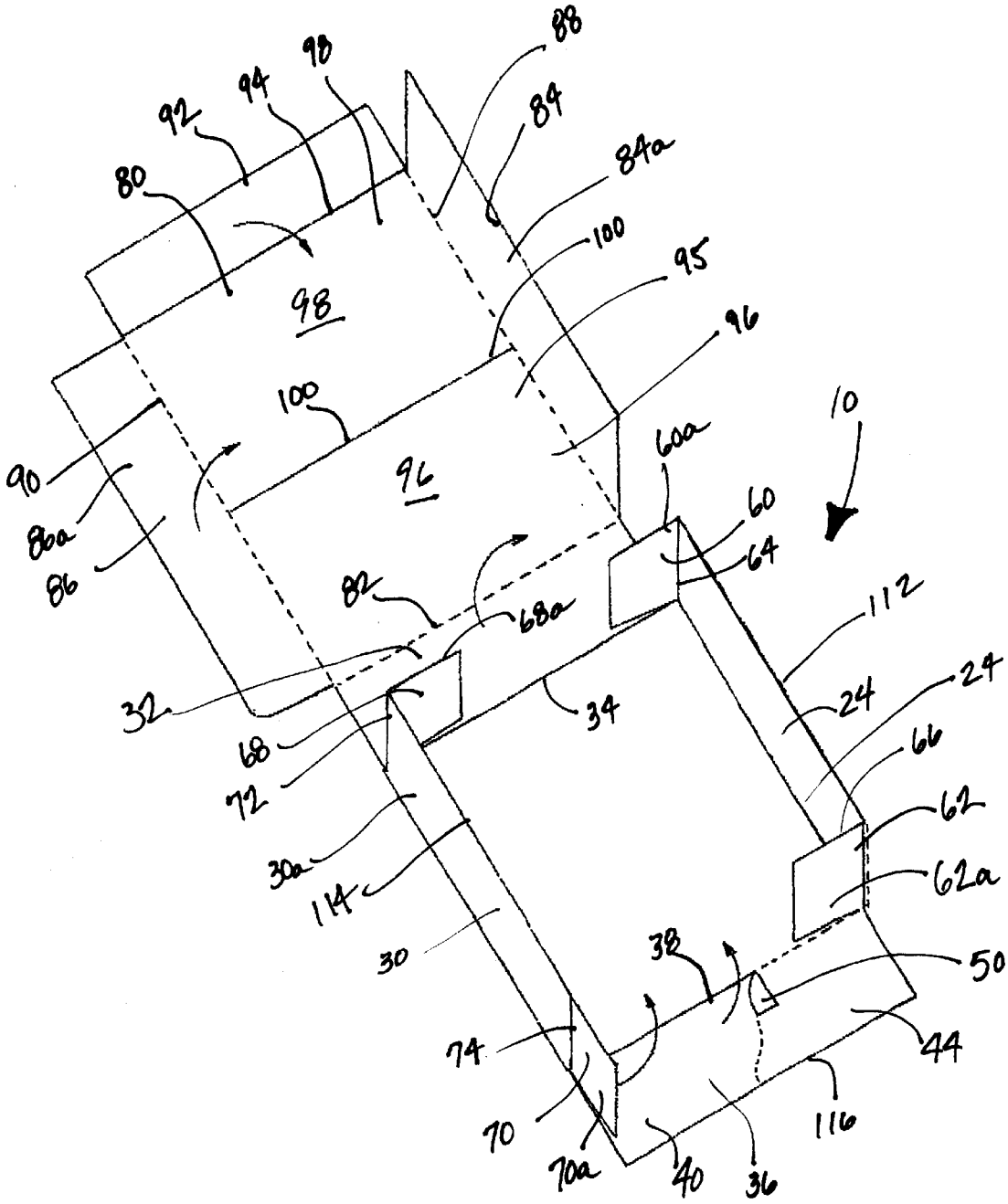
Figure 5:
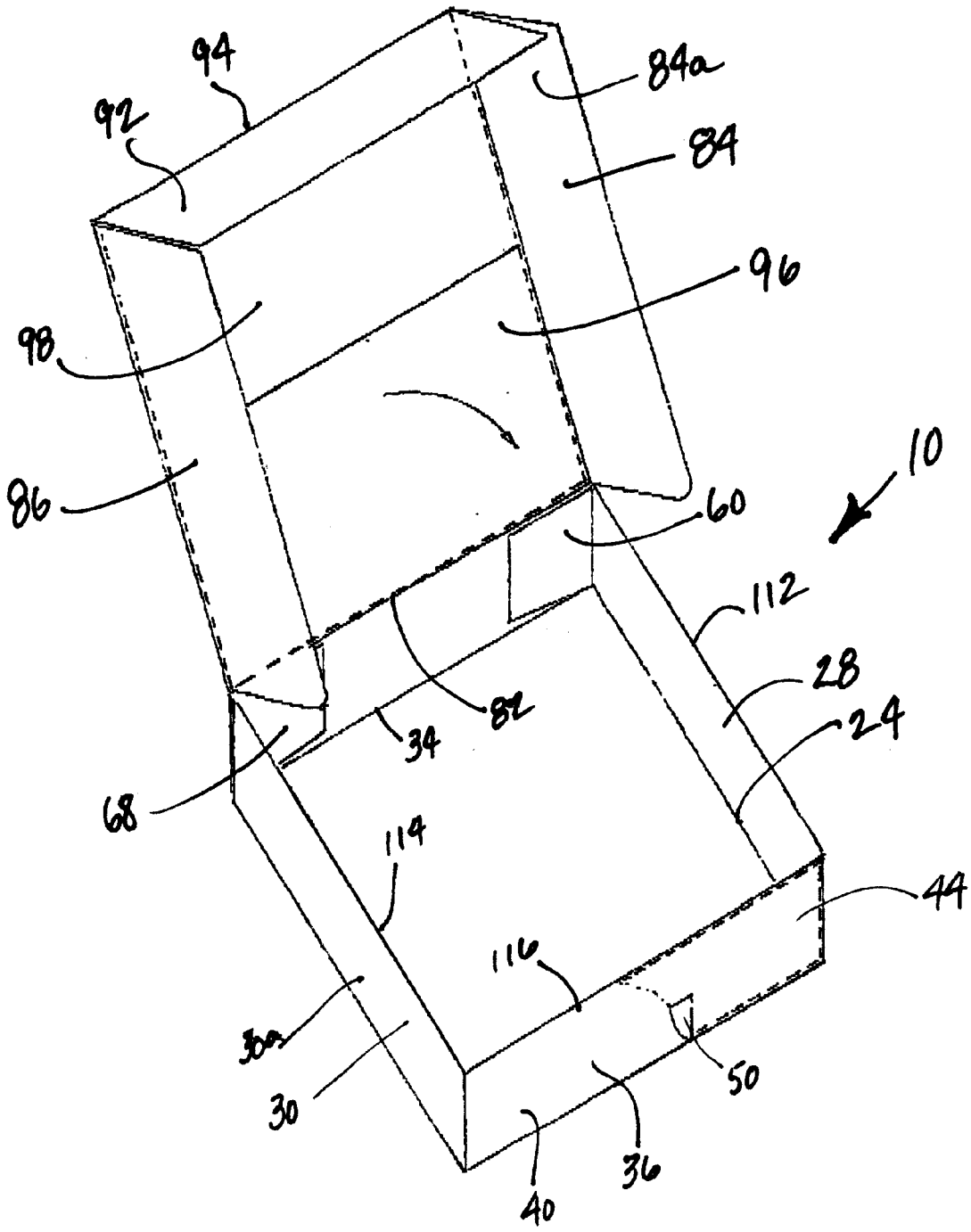
Figure 6:
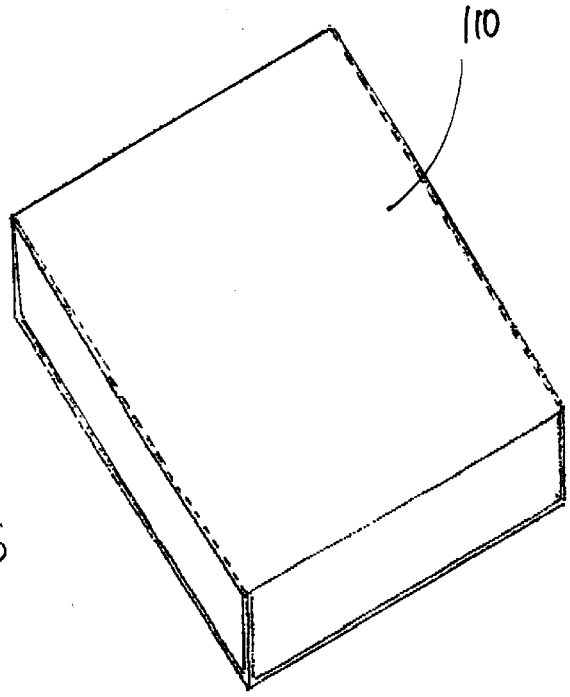

The first and second side flaps 28, 30 are folded up along the score lines 24, 26, respectively, as shown in FIGS. 3 and 4. Before, during or after this folding step the tabs 60, 62, 68, 70 are folded up/in relative to the first and second side flaps 28, 30 along the score lines 64, 72, 74 and along the scored and perforated line 66. Adhesive of any suitable type is applied to outwardly-directed faces 60*a*, 62*a*, 68*a*, 70*a* (see also FIG. 1) of the tabs 60, 62, 68, 70, respectively, at any suitable point in the process. Thereafter, the display flap 36 and the intermediate panel 32 are folded upwardly along the lines 38 and 34, respectively, and adhesively attached to the outwardly-directed faces 60*a*, 62*a*, 68*a*, 70*a* of the tabs 60, 62, 68, 70 (FIG. 5).

If desired, the foregoing steps can be undertaken in any suitable sequence. For example, one or both of the tabs 60, 62 may be folded upwardly relative to the first side flap 28 and the first side flap 28 may thereafter be folded upwardly relative to the first main panel 22. One or both of the tabs 68, 70 can then be folded upwardly relative to the second side flap 30 and the second side flap 30 may thereafter be folded upwardly relative to the first main panel 22. Adhesive can then be applied to the outwardly-directed faces 60*a*, 62*a*, 68*a*, 70*a* of the tabs 60, 62, 68, 70 and the display flap 36 and the intermediate panel 32 may be folded upwardly in sequence or simultaneously into contact with the outwardly-directed faces 60*a*, 62*a*, 68*a*, 70*a* of the tabs 60, 62, 68, 70.

Referring again to FIGS. 3 and 4, the third and fourth side flaps 84, 86 are then folded up along the scored and perforated lines 88, 90, respectively, relative to the second main panel 80. Before, during or after such folding, adhesive is applied to inner faces 84*a*, 86*a* of the third and fourth side flaps 84, 86. After placing product in the carton, and as seen in FIG. 5, the second main panel 80 is then folded down along the scored and perforated line 82 until the second main panel 80 contacts one or more of upper edges 112, 114 of the first and second side flaps 28, 30 and an upper edge 116 of the display flap 36. The third and fourth side flaps 84, 86 are then folded down into contact with and adhered to outer surfaces 28*a*, 30*a* (also see FIG. 1) of the first and second side flaps 28, 30. If desired, adhesive may be applied to the outer surfaces 28*a*, 30*a* in addition to or in place of the adhesive on the inner faces 84*a*, 86*a* of the third and fourth side flaps 84, 86. Alternatively or in addition, the third and fourth side flaps 84, 86 may be held in place by adhesive tape or any other securing means (not shown). Finally, the cover flap 92 is folded down along the score line 94 and the cover flap 92 is attached to the display flap 36, preferably by adhesive tape (not shown), so that the carton 110 assumes the erected shipping form shown in FIG. 6.

Figure 7:
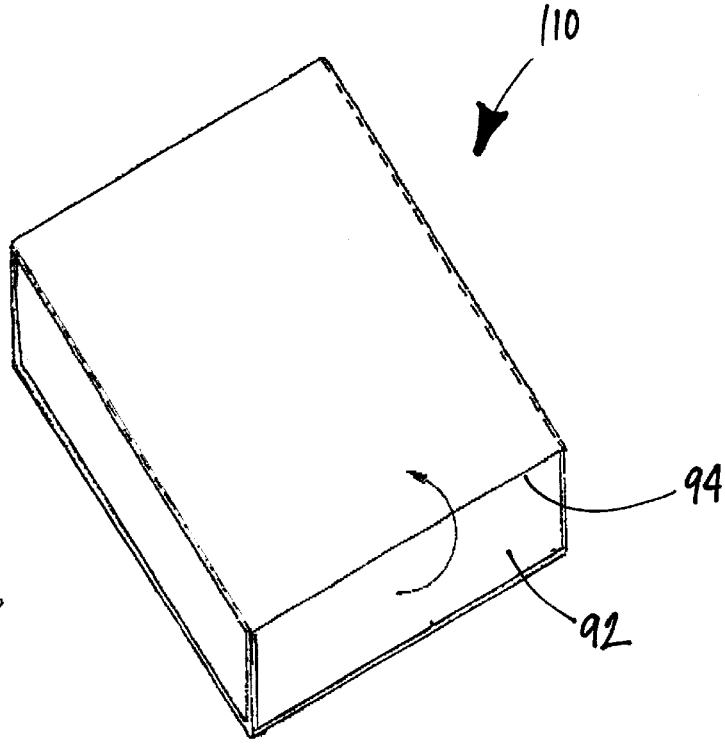
FIGS. 7–9 are isometric views steps undertaken to convert the carton of FIG. 6 from a shipping form to a display form.
Figure 8:
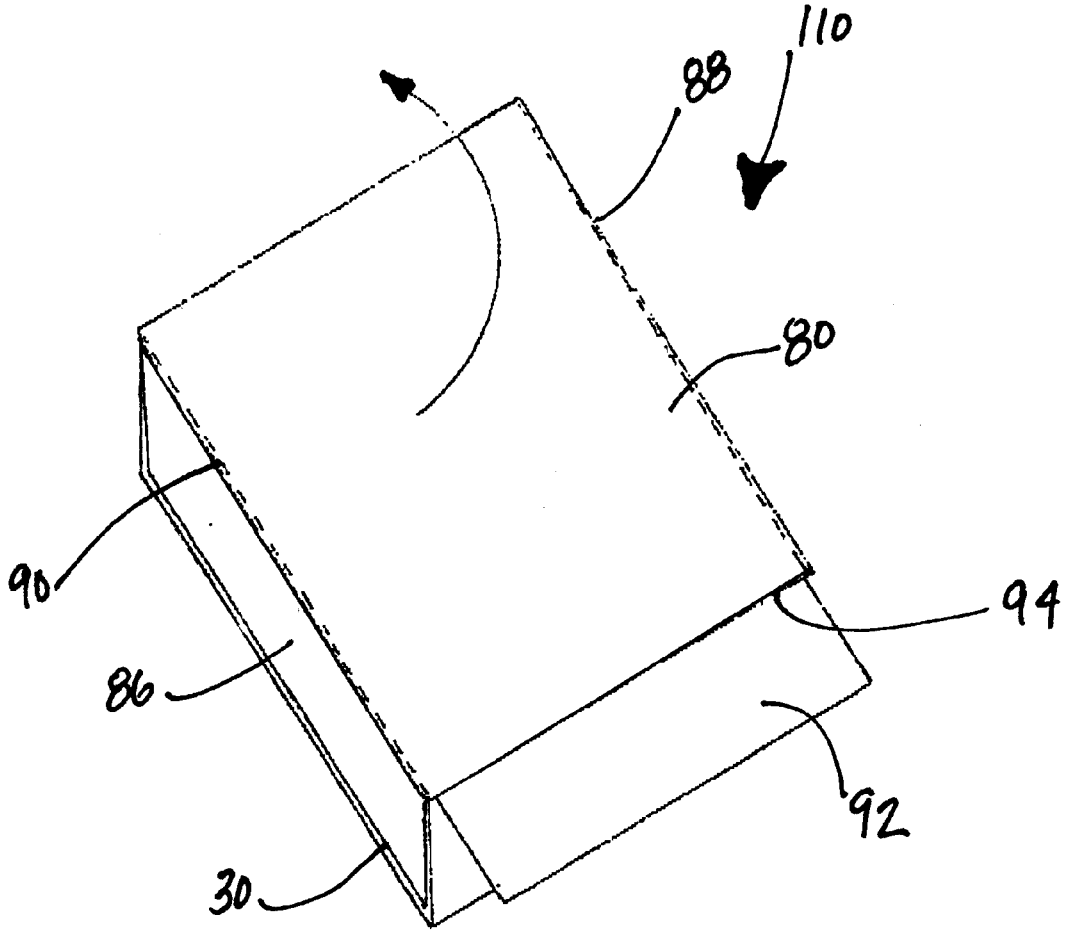

The process of converting the erected carton 110 into a first display form is shown in FIGS. 7–11. Referring to FIG. 7, the adhesive tape seal is first broken or severed by a user and the cover flap 92 is folded up along the score line 94. Referring to FIG. 8, the second main panel 80 is then pulled up and torn from the third and fourth side flaps 84, 86 along the scored and perforated lines 88 and 90, respectively. The third and fourth side flaps 84, 86 remain secured to the first and second side flaps 28, 30 after such tearing.

Figure 9:
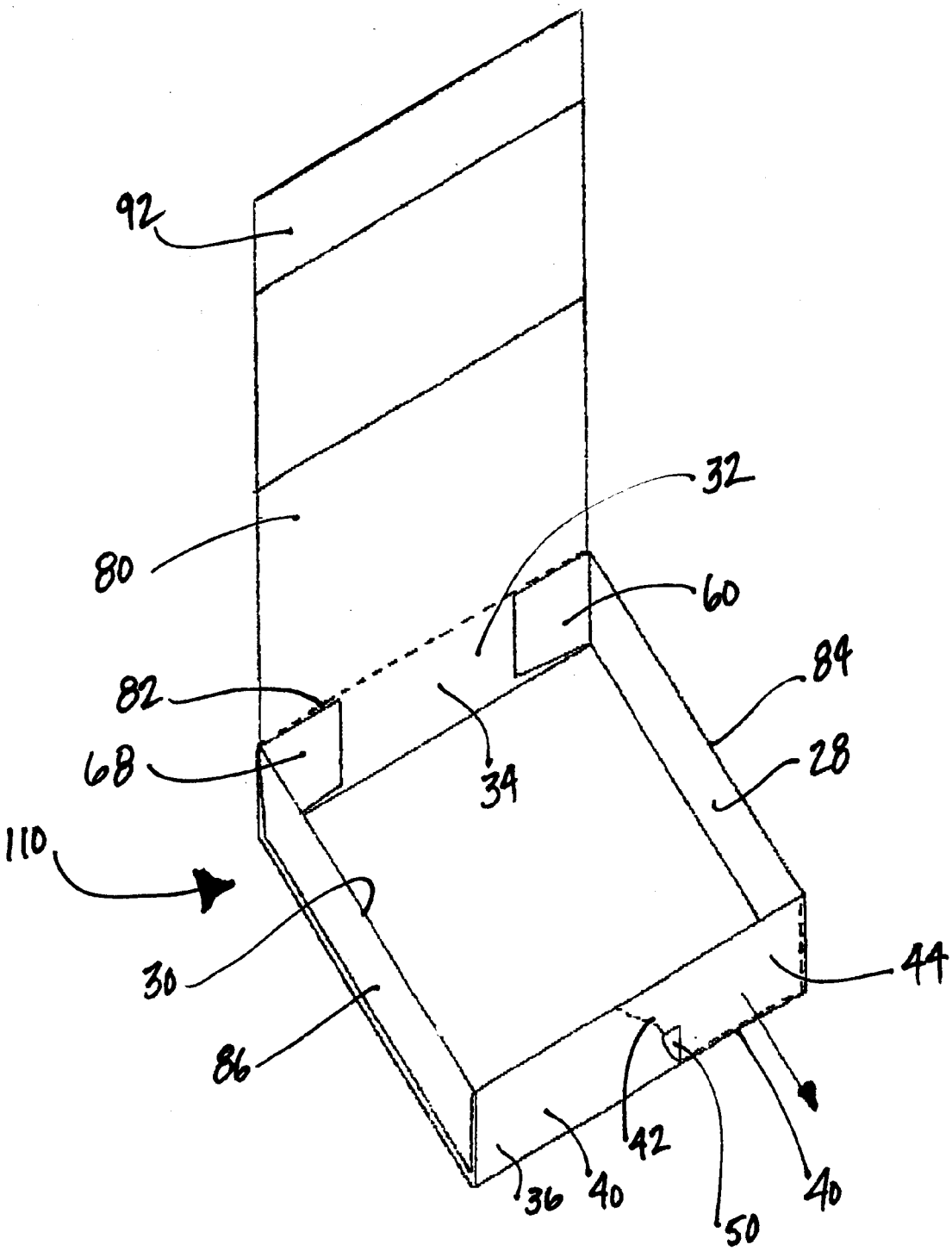

Then, referring to FIG. 9, the third section 50 is punched or knocked out (if it has not already been removed from the first and second sections 40, 44). The user inserts a finger into the hole left by removal of the third section 50 and grasps and removes the second section 44 of the display flap 36 from the first section 40 and the first main panel 22 by tearing at the perforated lines 42 and 48. At this time, the second tab 62 is also separated and removed from the first side flap 28 by tearing the scored and perforated line 66.

Figure 10:
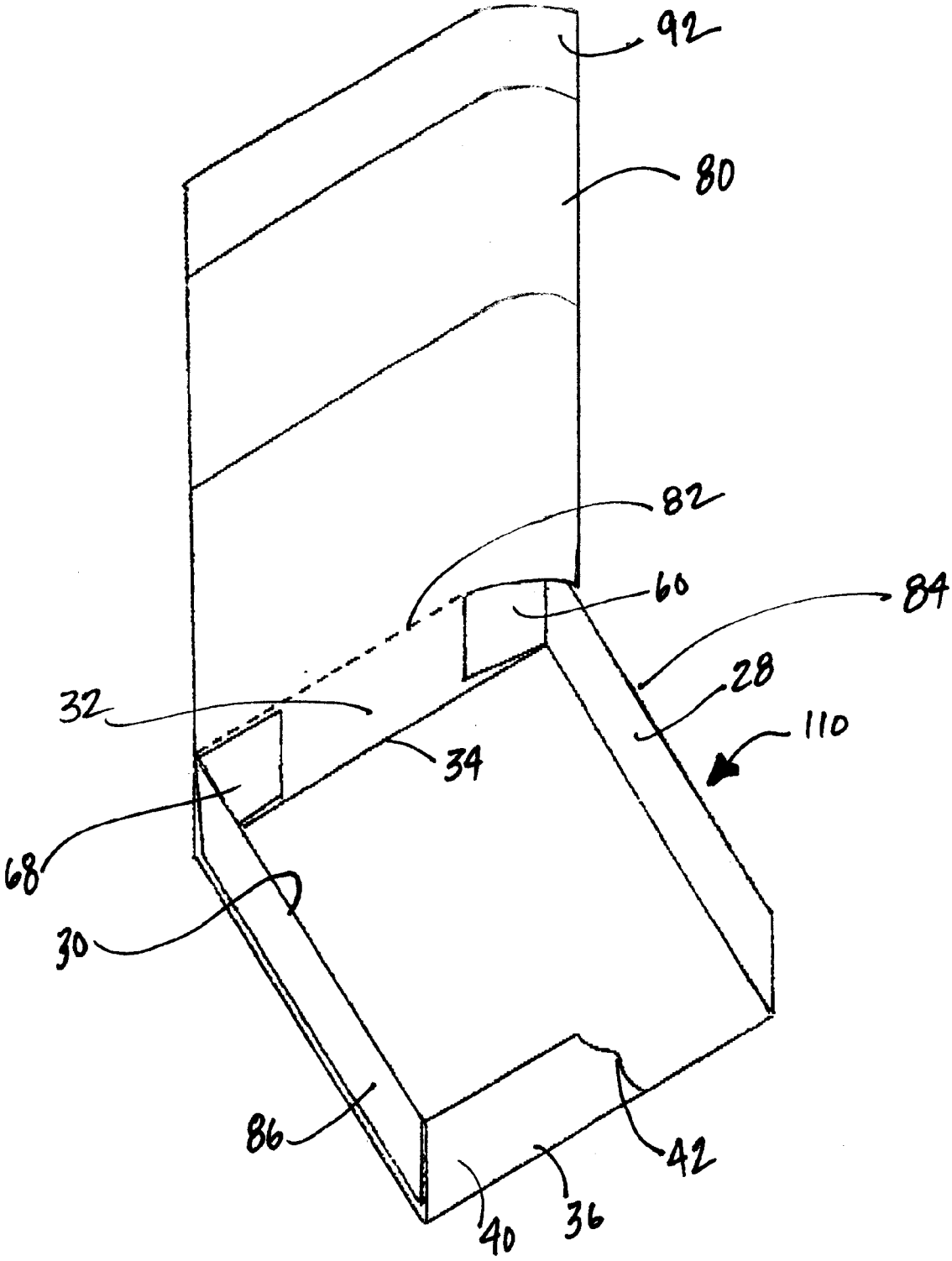
FIGS. 10 and 11 are isometric views of the carton of FIGS. 7–9 showing removal of the second main panel and cover flap to complete the conversion process to a display form according to a first embodiment of the present invention.
Figure 11:
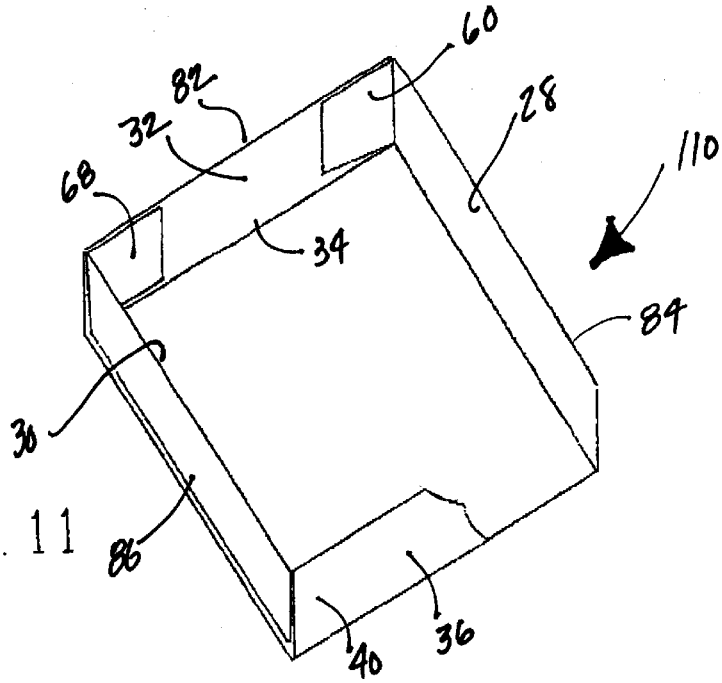

At this point, the user has the option of converting the carton 110 into one of two display forms. If the carton is to be placed in closely-spaced shelves, the user may elect to remove the second main panel 80 and the attached cover flap 92 from the intermediate panel 32 (and the remainder of the carton 110) by tearing along the scored and perforated line 82, as seen in FIG. 10 to obtain the configuration shown in FIG. 11. This configuration comprises a first or limited height display form. Once the carton 110 is placed on the merchant's shelf with the display flap 36 facing outwardly, purchasers can readily observe printed material provided on the first section 40 identifying and/or promoting the product in the carton 110.

Figure 12:
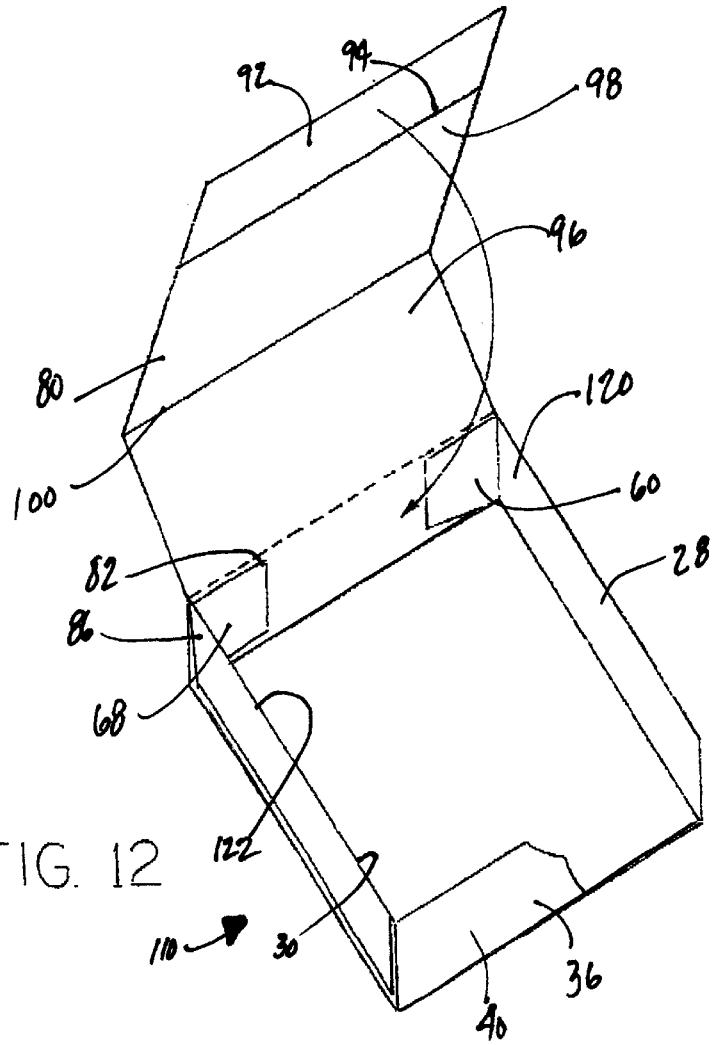
FIGS. 12 and 13 are isometric views of the carton of FIGS. 7–9 showing folding of the second main panel and cover flap and tucking of such elements to complete the conversion process to a display form according to a second embodiment of the present invention
Figure 13:
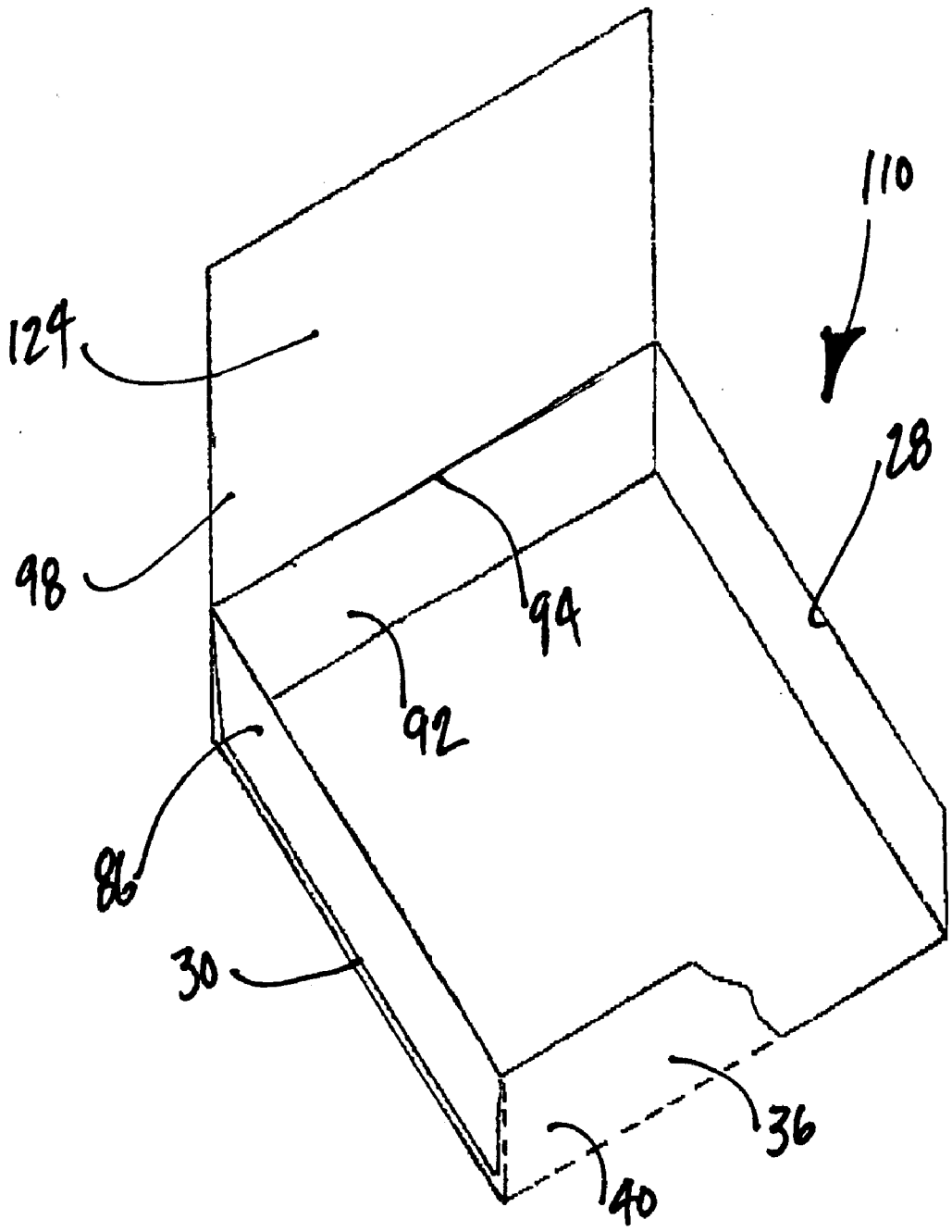

In the event that the carton 110 is to be placed at a location where vertical spacing is not a limiting factor, the user may elect to convert the carton from the configuration shown in FIG. 9 to a second display form. Specifically, as seen in FIG. 12, the user folds the second main panel 80 along the score line 100 to place the second folding panel section 98 into face-to-face abutment with the first folding panel section 96. At this point the user tucks the cover flap 92 into abutment with the tabs 60, 68. The side edges of the cover flap 92 and adjacent portions of the second folding panel section 98 remaining after tearing of the scored and perforated lines 88 and 90 may slightly engage inner surfaces 120, 122 of the side flaps 28, 30 to maintain the second folding panel section 96 in position against the first folding panel section 98. Alternatively or in addition, the cover flap 92 may be tucked behind the product in the carton 110 and/or adhesive and/or adhesive tape may be used to maintain the second folding panel section 96 in upstanding position against the first folding panel section 98 as seen in FIG. 13. Preferably, an outer surface 124 of the second folding panel section 96 includes printed matter thereon identifying and/or promoting the product in the carton 110.

In either form, a purchaser or the merchant can easily observe how much product remains in the carton 110, due to the removal of the second section 44 of the display flap 36 from the first section 40 down to the level of the first main panel 22. This feature is particularly useful in the case of flat or small product. Further, the merchant need not unpack product from the carton 110 prior to display thereof. Promotional matter on the carton 110 is readily observed by the customer.

As an alternative to the embodiments described above, the cover flap 92 may be secured by any suitable fastening means to the display flap 36 and may further be configured substantially identically to the display flap 36. In other words, the cover flap 92 may include three sections shaped substantially identically to the sections 40, 44 and 50 and which are separated from one another by lines of substantially similar design and shape as the lines 42, 52, 54 and 56 when the cover flap 92 overlies the display flap 36. In such an embodiment, the section of the cover flap 92 overlying the section 44 may be secured to the second main panel 80 at a scored and perforated line. During conversion, the sections 50 and 44, and the sections of the cover flap 92 corresponding thereto may be removed, leaving the section 40 and the section of the cover flap 92 corresponding thereto in place. In this case, the remaining portion of the cover flap 92 may have printed matter thereon describing or referring to the product in the carton.

In still another embodiment, all or portions of one or more of the first through fourth side flaps 28, 30, 84, 86, the intermediate panel 32 and/or the tabs 60, 68 and 70 may be removed during the conversion process. This may be accomplished by tearing at one or more additional perforated lines or other line(s) of weakness. This may allow a the user to remove an entire corner of the carton to enhance the visibility of the product in the carton.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A carton blank, comprising:

first and second spaced main panels;

first and second side flaps abutting first and second side edges, respectively, of the first main panel;

third and fourth side flaps abutting first and second side edges, respectively, of the second main panel;

an intermediate panel disposed between first ends of the first and second spaced main panels;

a cover flap abutting a second end of the second main panel; and a display flap having first and second portions adjacent to one another wherein the first portion is joined to a second end of the first main panel by a score line and the second portion is joined to the second end of the first main panel by a perforated line collinear with the score line.

2. The carton blank of claim 1, wherein the second portion is joined to the first portion by a further perforated line.

3. The carton blank of claim 2, wherein a removable punch-out portion is disposed between the perforated lines.

4. The carton blank of claim 1, wherein each of the first and second side flaps includes an associated pair of opposing tabs defined by further score lines.

5. The carton blank of claim 4, wherein the further score line defining one of the opposing tabs adjacent the second portion is also perforated.

6. The carton blank of claim 1, wherein the second main panel includes an additional score line at an intermediate portion thereof.

7. The carton blank of claim 1, wherein the third and fourth side flaps are joined to the second main panel by combined score and perforated lines.

8. A carton, comprising:

top and bottom spaced main panels;

first and second side flaps abutting first and second side edges, respectively, of the bottom main panel;

third and fourth side flaps abutting first and second side edges, respectively, of the top main panel and secured to the first and second side flaps, respectively;

an intermediate panel integral with first ends of the top and bottom spaced main panels;

a display flap having first and second portions adjacent to one another wherein the first portion is joined to a second end of the bottom main panel by a score line and the second portion is joined to the second end of the bottom main panel by a perforated line collinear with the score line; and a cover flap joined to a second end of the top main panel and secured to the display flap.

9. The carton of claim 8, wherein the second portion is joined to the first portion by a further perforated line.

10. The carton of claim 9, wherein a removable punch-out portion is disposed between the perforated lines.

11. The carton of claim 8, wherein each of the first and second side flaps includes an associated pair of opposing tabs defined by further score lines.

12. The carton of claim 11, wherein the further score line defining one of the opposing tabs adjacent the second portion is also perforated.

13. The carton of claim 8, wherein the second main panel includes an additional score line at an intermediate portion thereof.

14. The carton of claim 8, wherein the third and fourth side flaps are joined to the second main panel by scored and perforated lines.

* * * * *